United States Patent [19]

Stout et al.

[11] 4,346,270

[45] Aug. 24, 1982

[54] TIMING MECHANISM WITH A DIGITAL CLOCK

[75] Inventors: Garry A. Stout, Bargersville; Donald L. Ray, Oaklandon, both of Ind.

[73] Assignee: Emhart Industries, Inc., Indianapolis, Ind.

[21] Appl. No.: 174,756

[22] Filed: Aug. 4, 1980

[51] Int. Cl.[3] ..... H01H 43/00

[52] U.S. Cl. ..... 200/33 R; 68/12 R; 200/38 B; 368/222; 368/254

[58] Field of Search ..... 368/222, 235, 254; 307/141; 200/153 LB, 33 R, 38 R, 38 B, 38 BA, 38 A, 38 C, 38 FA; 134/58 D, 58 R, 113; 68/12 R

[56] References Cited

U.S. PATENT DOCUMENTS

| | | | |
|---|---|---|---|
| 3,540,029 | 11/1970 | Bassett | 368/254 |
| 3,721,086 | 3/1973 | Flumm | 368/222 |
| 3,903,687 | 9/1975 | Marquis | 368/222 |

*Primary Examiner*—J. V. Truhe
*Assistant Examiner*—Morris Ginsburg
*Attorney, Agent, or Firm*—Robert F. Meyer; David W. Gomes

[57] ABSTRACT

A digital clock is coupled to a cam means of a timing mechanism so that the clock can indicate the time remaining of a cycle provided by the cam means. One of the display wheels of the clock is intermittently rotated through the stored energy of a torsion spring, the energy being stored when the wheel is prevented from rotating by a slider which engages the wheel. A second display wheel is intermittently rotated as the first wheel is rotated through a geneva gear system which couples the two wheels together.

13 Claims, 4 Drawing Figures

TIMING MECHANISM WITH A DIGITAL CLOCK

BACKGROUND OF THE INVENTION

Generally speaking, the present invention relates to a timing mechanism having a digital clock to indicate cycle times of the cam means for the timing mechanism, the digital clock comprising a shaft rotatably mounted in a frame, a first coupling means coupling the cam means to the shaft for rotation with the cam means, a first display wheel carried on the shaft to be independently rotatable from the shaft, actuator means coupled to the shaft, a torsion spring coupled to the actuator means and the display wheel, stop means carried on the wheel, and a slider slideably carried in the frame and engaging the actuator means and the stop means to selectively stop rotation of the display wheel in response to the actuator means.

The present invention pertains to a timing mechanism and more particularly to a timing mechanism which has a digital clock for indicating cycle times that are provided by a cam means of the timing mechanism.

Timing mechanisms have been used for many years to control the machine functions of appliances such as washers, dryers and dishwashers. In recent years, it has been found to be desirable to provide a digital clock with the timing mechanism so that the operator of the appliance may determine the time remaining of the cycles of the timing mechanism. For example, it has been found to be desirable to use such a clock in timing mechanisms that are used in dishwashers. In such applications, apparatus needs to be provided to operate the digital clock directly from the operation of the cam means of the timing mechanism such that the time of the cycles of the cams can be accurately determined. In addition, it is necessary to keep the number of parts of the apparatus to a minimum with close tolerances for timing accuracy.

FEATURES OR OBJECTS OF THE INVENTION

It is, therefore, a feature of the present invention to provide a timing mechanism in combination with a digital clock. Another feature of the invention is the provision of such a timing mechanism wherein the digital clock operates directly from a cam means of the timing mechanism. Another feature of the invention is the provision of such a timing mechanism wherein the digital clock includes a display wheel that is carried on a shaft that is directly coupled to the cam means. Another feature of the invention is the provision of such a timing mechanism wherein the display wheel is intermittently rotated through the stored energy of a torsion spring coupled between the display wheel and an actuator means that is coupled to the shaft. Still another feature of the invention is the provision of such a timing mechanism wherein the energy is stored in the spring by intermittently preventing rotation of the display wheel. Yet another feature of the invention is the provision of such a timing mechanism wherein the wheel is intermittently prevented from rotating through a slider which intermittently engages the wheel through the actuator means.

Another feature of the invention is the provision of such a timing mechanism having a second display wheel. Another feature of the invention is the provision of such a timing mechanism wherein the second display wheel intermittently rotates with respect to the first display wheel through a geneva drive system. Still another feature of the invention is the provision of such a timing mechanism wherein the geneva drive system includes individual gears carried on the display wheels and intermediate gears carried in a cradle carried by the shaft for the display wheels.

These and other features of the invention will become apparent from the following description taken in conjunction with the accompanying drawings.

Figure 2:
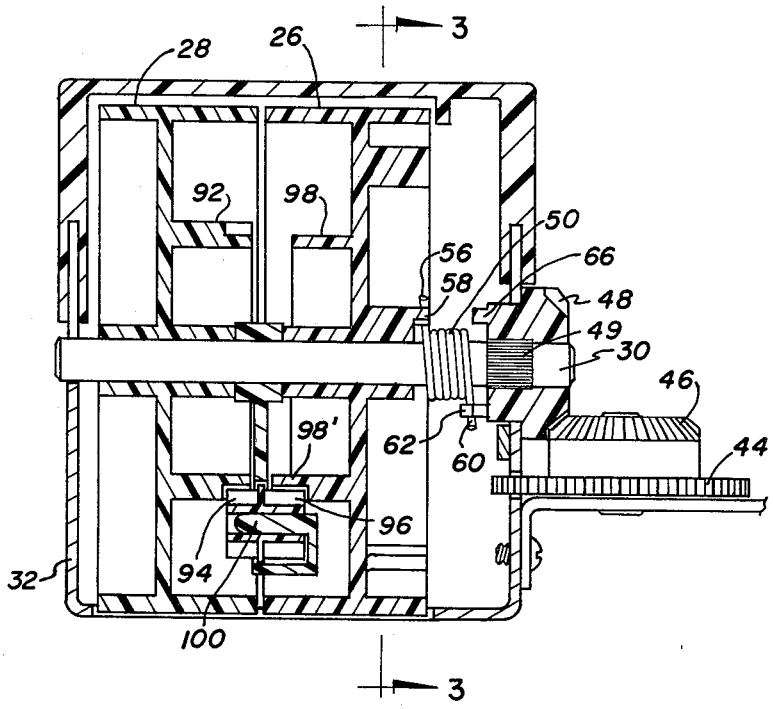
FIG. 2 is a section taken along the line 2—2 of FIG. 1.
Figure 3A:
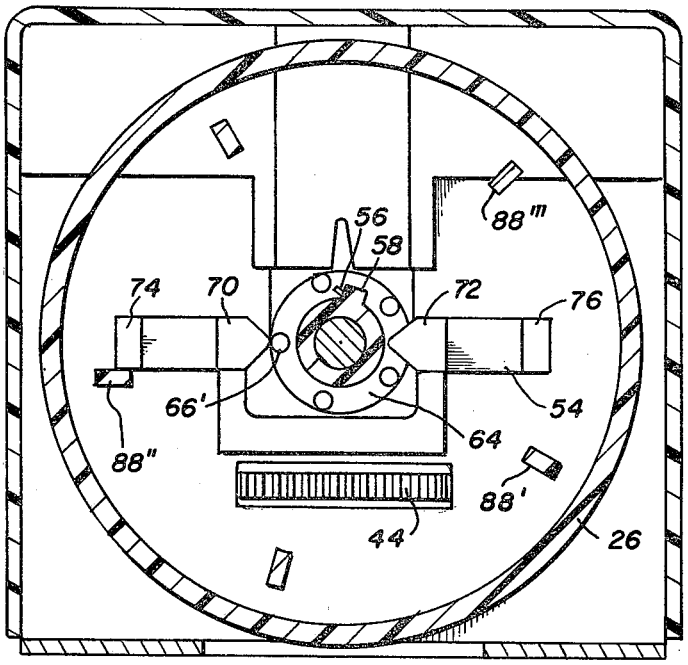
Figure 3B:
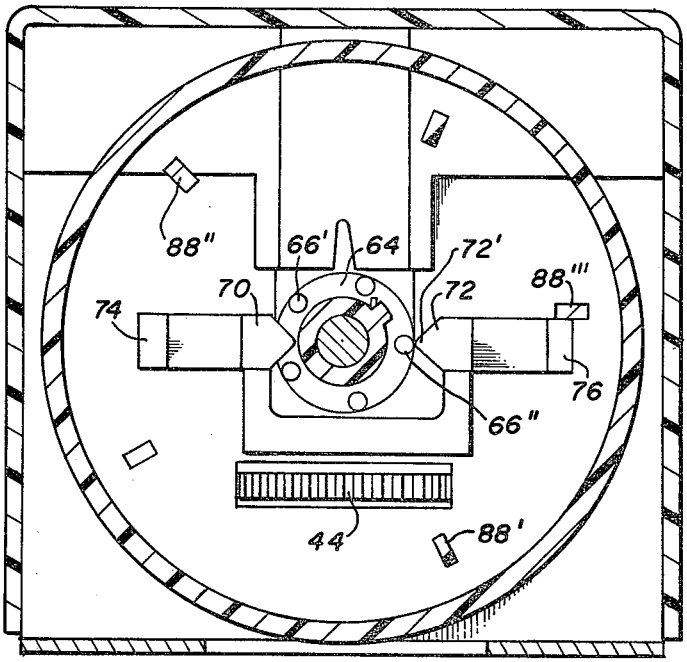

FIGS. *3a* and *3b* are views taken along the line 3—3 of FIG. 2 showing different operating modes of the digital clock.

DETAILED DESCRIPTION OF THE INVENTION

Figure 1:
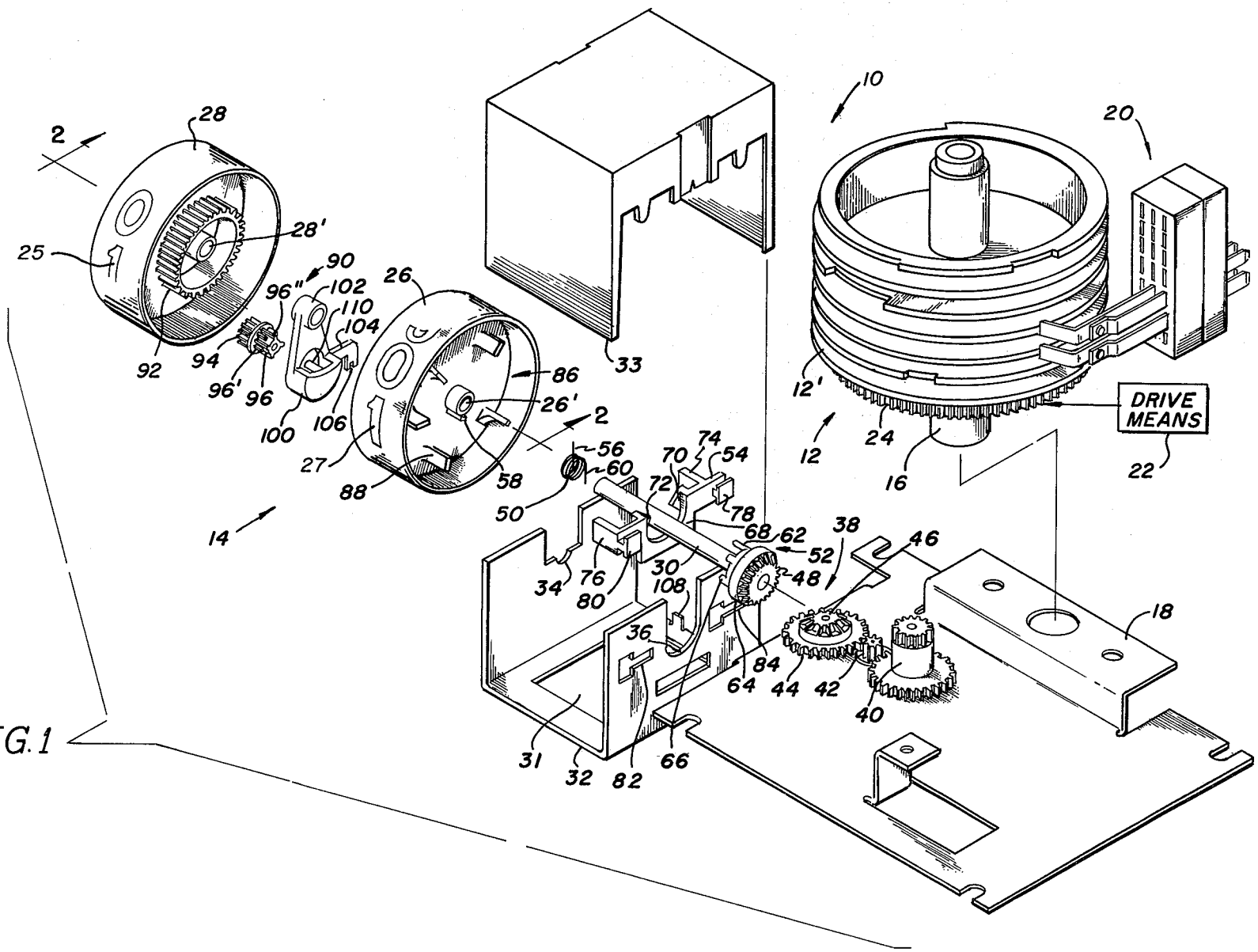
FIG. 1 is an exploded view of a portion of a timing mechanism having a digital clock employing the features of the invention.

Referring now to FIGS. 1 and 2, there is shown a timing mechanism 10 which, in general, includes cam means 12 and a digital clock means 14. Cam means 12 includes a plurality of cams 12' which are carried on a cam shaft 16 that is rotatably journalled in base plate 18, and a plurality of electrical switches 20 (only two shown) which engage the plurality of cams to be opened and closed in accordance with a program provided by the cams. The cams are rotatably driven through a suitable drive means 22 which, as schematically shown, is coupled to a drive gear 24 and is also carried on shaft 16. Drive means 22 could be of any suitable type known in the industry, such as a synchronous motor and a speed reducing gear train and could also include an escapement if intermittent rotation of the cams is desired. The operation of the cams and the switches are well known in the art and, therefore, in the interest of simplicity, the complete timing mechansim is not shown or described in detail.

Digital clock means 14 includes display wheels 26 and 28 which are carried on a shaft 30 through hub portions 26' and 28' to be independently rotatable on the shaft. Each of the wheels have coded indicia 25 and 27 on their outer surfaces which for the present embodiment indicate minutes. The coded indicia are shown through a window 31 provided in frame 32. A cover 33 fits over frame 32. Shaft 30, with the wheels 26 and 28, is rotatably carried in frame 32 through bearing surfaces 34 and 36. Shaft 30 is coupled to cam means 12 through a coupling means 38 which includes gear and pinion 40, idler gear 42, gear 44 and mating bevel gears 46 and 48. Bevel gear 48 is fixedly held on shaft 30 through spline 49 to cause shaft rotation. As shown, gear and pinion 40, idler gear 42, and gear 44 with its bevel gear 46 are rotatably journalled on base plate 18.

Display wheel 26 is intermittently rotated through a combination of torsion spring 50, actuator means 52 and slider 54. Torsion spring 50 is coupled between drive wheel 26 and actuator 52 through an end 56 engaging a rib 58 which is carried on hub 26' of the wheel and another end 60 engaging a projection 62 of actuator means 52. Actuator 52 includes a rotating member 64 that is fixedly carried on or otherwise coupled to bevel gear 48, the rotating member having a plurality of pegs 66 extending from a face of the rotating member and spaced about its periphery. As shown, projection 62 is an extension of one of the pegs 66 of the actuating means.

Slider 54 includes a body portion 68, a pair of oppositely disposed tangs 70 and 72, and a pair of oppositely disposed ears 74 and 76 extending from the body portion 68. The slider is slideably carried in frame 32 through sliders 78 and 80 which are slideably carried in notches 82 and 84. Rotation of the display wheel 26 is intermittently prevented through slider 54 by ears 74 and 76 engaging stop means 86 provided within display wheel 26. Stop means 86 includes a plurality of posts 88 which are spaced about the inner periphery of the display wheel.

The display wheels with the cam means are permanently set at zero by the manufacturer. In operation, and with reference to FIGS. 1, *3a* and *3b*, drive means 22 rotates the cam means 12 including gear 24 which causes rotation of shaft 30 through coupling means 38. Rotation of bevel gear 48 causes rotation of shaft 30 as well as rotating member 64 of actuator means 52. In the embodiment shown in FIGS. *3a* and *3b*, member 64 is continuously rotating clockwise as viewed in the Figures. In FIG. *3a*, peg 66' has engaged tang 70 and moved slider 54 to place ear 74 in the position shown and post 88' has just cleared ear 76 allowing wheel 26 to rotate in a clockwise direction as viewed in the Figures, due to previously stored energy in spring 50, until 88'' engages ear 74 as shown in FIG. *3a*. Referring to FIG. *3b*, continuous rotation of member 64 causes peg 66'' to engage tang 72 to move slider 54 and place ear 76 in the position shown. During this period, and before peg 66'' has reached the tip 72' of tang 72, the rotation of member 64 has coiled spring 50 to again store energy in the spring. More specifically, the width of the posts 88 and 88'' as well as all the other posts 88 are sufficient to prevent rotation of wheel 26 until peg 66'' reaches the tip 72' of tang 72. Upon reaching the tip of the tang, ear 74 is completely released from post 88'' to permit wheel 26 to rotate until post 88''' engages ear 76. The cycle is then repeated.

Referring now to FIGS. 1 and 2, display wheel 28 rotates in accordance with the rotation of display wheel 26 through coupling means 90. Coupling means 90 includes a gear 92 fixedly carried within the wheel 28, gear 94 which meshes with gear 92, and geneva pinion 96 which meshes with geneva gear 98 carried on wheel 26. The geneva gearing is typical of prior art systems and therefore will only briefly be described. Gears 92 and 94 are straight gears while pinion 96 and gear 98 are mutilated. Gear 98 has teeth 98' covering about 8% of the gear's periphery while pinion 96 has short teeth 96' and long teeth 96''. The short and long teeth both are driven by the teeth 98' when they are engaged. When they are not engaged, the long teeth 96'' engage the teethless portion of the periphery of gear 98 to prevent rotation of geneva pinion 96. As shown, the one piece structure of gear 94 and geneva pinion 96 are carried in a cradle 100 that is carried on shaft 30 through hub 102 and which is held in a fixed position through a tongue 104 having a notch 106 which engages a tab 108 carried by frame 32. The one piece structure of gear 94 and geneva pinion 96 is rotatably carried on a post 110 which is provided within the cradle.

What is claimed is:

1. In combination, a timing mechanism wherein a cam means is rotated to open and close electrical switches operably associated therewith, a digital clock means indicating cycle times of said cam means comprising:

(a) a shaft rotatably mounted in a frame, (b) a first coupling means coupling said cam means to said shaft for rotation with said cam means, (c) a first display wheel carried on said shaft to be independently rotatable from said shaft, (d) actuator means including a rotating member coupled to said shaft and at least one peg extending from said rotating member, (e) a torsion spring coupled to said actuator means and said display wheel, (f) stop means carried on said wheel, and (g) a slider slideably carried in said frame and engaging said one peg and said stop means to selectively stop rotation of said display wheel in response to said actuator means.

2. In a combination according to claim 1 wherein said coupling means includes a pair of mating bevel gears whereby said shaft rotates on an axis normal to an axis of rotation of said cam means.

3. In a combination according to claim 1 wherein said rotating member has a plurality of pegs projecting therefrom and engaging said slider.

4. In a combination according to claim 3 wherein said pegs engage oppositely disposed tangs.

5. In a combination according to claim 3 wherein one peg of said plurality of pegs is longer than the other of said pegs and wherein an end of said torsion spring is connected to said one peg.

6. In a combination according to claim 5 wherein another end of said torsion spring is connected to a hub of said display wheel.

7. In a combination according to claim 1 wherein said stop means includes a plurality of posts extending around and from an inner face of said display wheel.

8. In a combination according to claim 7 wherein a pair of ears one each extends from opposite ends of said slider.

9. In a combination according to claim 1 wherein said digital clock means further includes a second display wheel carried on said shaft and independently rotatable therefrom, and second coupling means coupling said first and second display wheels.

10. In a combination according to claim 9 wherein said second coupling means includes a geneva gear system.

11. In a combination according to claim 10 wherein said geneva gear system includes individual gears carried by said first and second display wheels, and intermediate gears carried in a cradle carried by said shaft.

12. In a combination according to claim 11 wherein said cradle includes means anchoring same to said frame.

13. In a combination according to claim 12 wherein said anchoring means includes a tongue extending from the body of said cradle and having a notch therein engaging said frame.

* * * * *